United States Patent [19]

Patterson et al.

[11] 4,349,009

[45] Sep. 14, 1982

[54] COMBUSTION AIR SYSTEM

[75] Inventors: Eddy L. Patterson; George D. Patterson, both of McKinney, Tex.

[73] Assignee: Overhead Door Corporation, Dallas, Tex.

[21] Appl. No.: 126,740

[22] Filed: Mar. 3, 1980

[51] Int. Cl.[3] ..... F24B 7/00

[52] U.S. Cl. ..... 126/121; 98/46; 126/77; 126/131; 165/DIG. 2; 237/51; 237/55

[58] Field of Search ..... 126/120, 121, 131, 142, 126/143, 141, 126, 139, 77, 112, 15 R; 237/51, 55; 98/46; 165/DIG. 2

[56] References Cited

U.S. PATENT DOCUMENTS

| | | | |
|---|---|---|---|
| 2,671,440 | 3/1954 | Dupler | 126/121 |
| 2,818,060 | 12/1957 | Field | 126/307 |
| 2,821,975 | 2/1958 | Thulman | 126/120 |
| 3,724,443 | 4/1973 | Carson | 126/121 |
| 3,888,231 | 6/1975 | Galluzzo et al. | 126/120 |
| 4,010,728 | 3/1977 | Hempel et al. | 126/120 |
| 4,043,313 | 8/1977 | Sherman | 126/121 |
| 4,089,320 | 5/1978 | Brown et al. | 126/121 |
| 4,108,144 | 8/1978 | Wilhoite | 126/120 |
| 4,169,458 | 10/1979 | Shaw | 126/121 |
| 4,184,473 | 1/1980 | McIntire et al. | 126/121 |
| 4,224,921 | 9/1980 | Petrescue | 126/120 |
| 4,230,092 | 10/1980 | Henriques | 126/120 |
| 4,233,956 | 11/1980 | Haynes | 126/121 |
| 4,259,941 | 4/1981 | Gerdes | 126/120 |
| 4,280,473 | 7/1981 | Hempel | 126/120 |

*Primary Examiner*—Daniel J. O'Connor
*Attorney, Agent, or Firm*—Kenneth R. Glaser

[57] ABSTRACT

Air circulation and supply means for a heat generator, primarily a fireplace. The fireplace has air supply and discharge passageways such that an envelope of moving air is provided around both the combustion gas flue and the firebox and a portion of said supply air is introduced as combustion air into said firebox. More specifically, an air siphon is provided whereby both the firebox and the flue of combustion gases are substantially surrounded (except for the firebox opening) by three walls wherein relatively cold external air flows downwardly from the atmosphere between the outer wall and the intermediate wall and flows upwardly to the atmosphere between the intermediate wall and the innermost wall. An air channel is provided across and along the top of the fireplace opening and connected so that air may flow therethrough from the space between two of said walls and can be discharged therefrom into the upper part of the firebox. The entire firebox and flue for combustion gases are thereby insulated from surrounding combustible building materials and some of the outside air is introduced into the firebox for the support of combustion therein.

20 Claims, 8 Drawing Figures

COMBUSTION AIR SYSTEM

FIELD OF THE INVENTION

The invention relates to air circulation and control means for a heat generator, primarily a fireplace, and particularly to air circulation and flow control means comprising an air siphon by which relatively cold external air is caused to completely surround the firebox and combustion gas flue thereby insulating the surrounding combustible building materials, and it relates further to the provision of means by which air from within said air siphon may be introduced into said firebox for the support of combustion therein.

BACKGROUND OF THE INVENTION

In the design of heat generators primarily intended for the burning of solid fuel in domestic use, and most especially in connection with fireplaces, it has long been known to provide an air siphon by which cold external air is caused to flow in an envelope essentially surrounding the combustion gas flue and also surrounding most of the firebox for the protection or insulation of surrounding combustible building materials. It is further known to cause said air then to pass upwardly adjacent said firebox and flue to provide the siphoning force effecting said aforementioned flow of protective external air. See for example U.S. Pat. Nos. 2,821,975 (Thulman), 3,888,231 (Galluzzo) or 4,010,728 (Hempel).

Such objective is usually accomplished by providing both the firebox and the combustion gas flue with two spaced surrounding envelopes both communicating at their respective upper or outer ends with the external atmosphere at or near the upper end of the combustion gas flue and preferably communicating with each other near the lower end of the firebox. In this manner, cold outside air may enter into one of the envelopes, normally the outer thereof, flow downwardly to the lower end of the firebox, flow thence into the inner envelope where it is heated to a temperature higher than that in the external envelope by which said air will then flow upwardly and return to the atmosphere. This so-called heat siphon provides a constant flow of cool external air surrounding the entire firebox and combustion gas flue thereby to protect surrounding construction materials, often of wood, from the heat of the firebox and combustion gas flue.

Most existing fireplaces, however, such as those shown in the above-mentioned patents, draw on conditioned (heated or cooled) air from within the home for principal or sole support for combustion resulting in substantial loss of conditioned air up the flue. Operation of this sort of fireplace on a cold day may actually cause a net heat loss or cool the home instead of warm it as frigid outside air is drawn in to replace conditioned air lost up the flue. Such loss may be reduced by the use of glass doors in the front of the firebox which allows the flow of air from the home to be controlled. At minimum, however, sufficient air must be admitted to the firebox to support adequate combustion.

In recent years both consumers and governmental authorities have recognized the importance of providing the fireplace with a source of combustion air from outside the conditioned atmosphere of the home. To be most effective such provision of outside air is typically coupled with the use of glass doors to seal the firebox from the atmosphere of the home.

In now fireplace designs the provision of outside air is accomplished by means of a supplementary vent (see Dupler U.S. Pat. No. 2,671,440) running either through a nearby exterior wall or adjacent to but independent of the flue. The fireplace design shown in above-mentioned U.S. Pat. No. 4,010,728, in its use of the thermaal siphon system as a heat circulating means, incidentally brings outside air into the home in the vicinity of the fireplace where, if the fireplace is not fitted with glass doors, some of that outside air may be drawn into the firebox. However, in this design, outside air is supplementary at best and there is no way (as by use of glass doors) to prevent the flow of conditioned air from the home into the firebox along with the outside air.

In view of this state of the art, the objects of the present invention include:

1. To provide air circulation and flow control means for conducting external air around the entirety of the firebox and its combustion gas flue for the protection of surrounding combustible materials and simultaneously to provide a supply of preheated combustion air to the firebox.

2. To provide air circulation and control means, as aforesaid, wherein the structure effecting such objective is simple in design, therefore, of minimum cost in fabrication, and capable of installation in new construction or by remodeling.

3. To provide air circulation and control means, as aforesaid, which will be adaptable to fireplaces of widely varying specific design and of a wide range of sizes.

4. To provide air circulation and control means, as aforesaid, which will require no moving parts other than adjustable dampers at the point of introduction of combustion air into the firebox.

5. To provide a device, as aforesaid, which will be completely reliable in operation and which in particular will insure a smooth and effective flow of air around all portions of the firebox and combustion gas flue which might otherwise be exposed to adjacent combustible materials.

6. To provide air circulation and control means, as aforesaid, which is able to meet existing building codes and avoid the dangers of overheating adjacent the firebox.

The present invention also provides an improved fireplace of the type having means for circulating cooling air around the exterior of the firebox wherein a portion of the cooling air may be conducted to the firebox combustion chamber to provide a portion or substantially all of the combustion air for supporting combustion within the firebox. In a preferred embodiment of the present invention the source of cooling air is exterior atmospheric air conducted to the fireplace by way of a flue section which includes means for conducting a thermally induced flow of air into and out of passages formed by spaced apart shells which surround the firebox.

In accordance with yet another aspect of the present invention there is provided an improved arrangement of heat shields disposed across a top wall portion of a firebox between the firebox hood and an interior front wall of the fireplace structure. The improved heat shield arrangement of the present invention is characterized by elongated tubular channel members which open at their opposite ends, respectively, to cooling air passages formed within spaced apart shells surrounding the firebox. In a preferred embodiment the combustion air conducted from the cooling air passages is drawn in through one of the tubular members and through suitable openings in the top wall of the firebox. Accordingly, the present invention also provides an improved arrangement of heat shields for a fireplace structure which is cooled by the circulation of cooling air from an outside source and wherein at least one of the heat shields also comprises conduit means for conducting combustion air from the cooling air passages into the firebox combustion chamber.

Other objects and purposes of the invention will be apparent to persons acquainted with a device of this general type by reading the following specification and inspection of the accompanying drawings.

DETAILED DESCRIPTION

Figure 1:
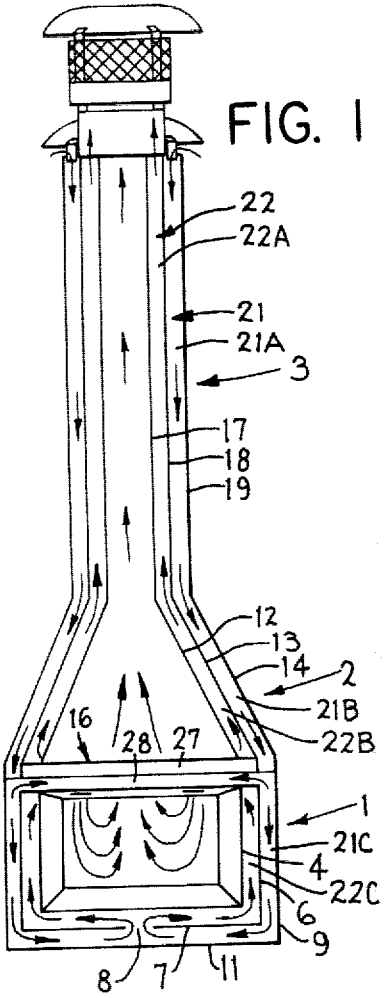
FIG. 1 is a schematic, front elevational view illustrating the air flow pattern in one preferred embodiment of the invention.

Referring now to the drawings and particularly to FIG. 1, there is shown an embodiment of the invention comprising a firebox section 1, a hood section 2, and a stack 3. The firebox section comprises a firebox 4 of generally conventional nature and preferably of a suitable metal such as steel. Said firebox section is surrounded on the sides by an intermediate wall 6 and on the bottom by intermediate wall 7 which latter is perforated at 8. The intermediate wall 6 is surrounded on the sides by an outer wall 9 spaced therefrom and a bottom wall 11 spaced from the wall 7.

Immediately above said firebox section 1 the hood section 2 comprises an inner hood 12 connected to the upper end of the firebox 4, an intermediate hood 13 connected to the upper end of the intermediate wall 6 and an outer hood 14 connected to the upper end of the outer wall 9. A cross channel section 16 extends across the bottom of said hood section 2 near the front thereof and in a manner to be further described hereinafter.

The stack 3 comprises a combustion gas flue 17 connected to the upper end of the inner hood 12 and discharging to the atmosphere, an intermediate pipe 18 is spaced outward from the flue 17 and is connected to the upper end of the hood 13, and an outer pipe 19, spaced outwardly from the intermediate pipe 18 is connected to the upper end of the outer hood 14. There is thus defined an outer passageway or envelope 21 communicating at its upper end with the atmosphere and extending downwardly as at 21A through the entire length of the stack or chimney, around the hood section 12 as at 21B and further extending around the entire firebox section 1 as at 21C.

There is also thus defined an intermediate passageway or envelope 22 immediately within the passageway 21 which likewise communicates at its upper end with the external atmosphere. Envelope 22 surrounds the combustion gas flue as at 22A, surrounds the inner hood 12 as at 22B, surrounds the firebox 4 as at 22C and communicates with the lower end of the outer passageway 21 at the opening 8. Lastly, combustion gases generated within the firebox 4 rise through the inner hood 12 into the combustion gas flue 17 from whence they are discharged into the atmosphere at the upper end of said flue 17.

All of the parts described in the foregoing paragraph are substantially conventional and form no part of the present invention excepting as same cooperate with, and affect or are affected by, the hereinafter-described components embodying the advance in the art.

Figure 5:
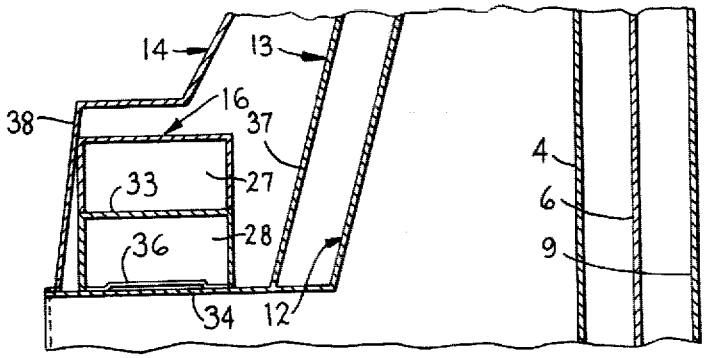
FIG. 5 is a section taken on the line V—V of FIG. 4.
Figure 6:
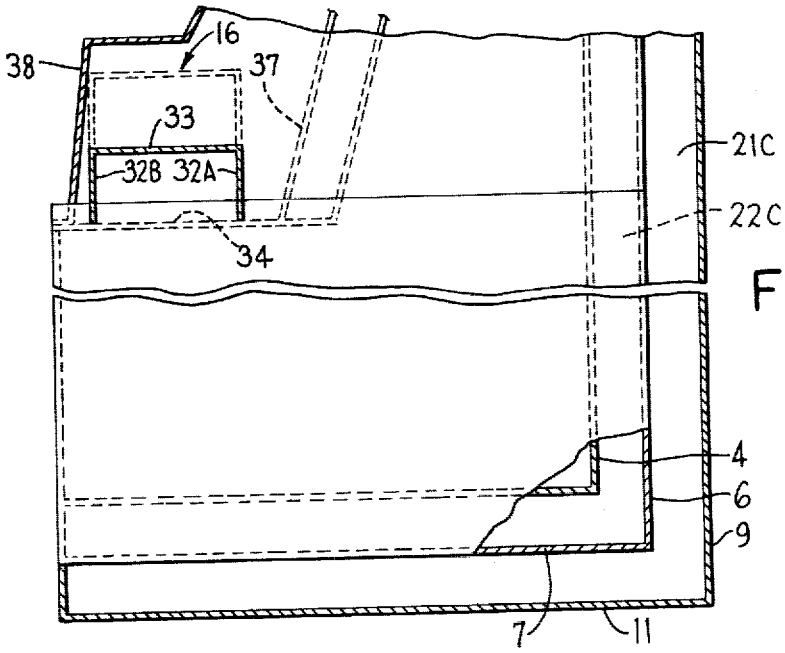
FIG. 6 is a section taken on the line VI—VI of FIG. 4.
Figure 7:
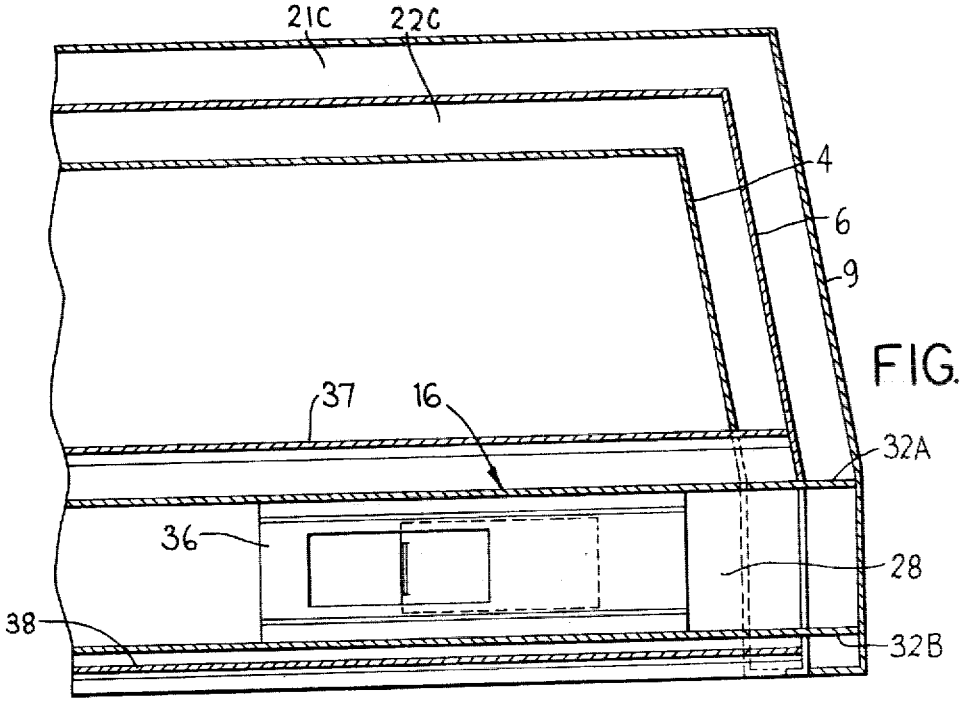
FIG. 7 is a section taken on the line VII—VII of FIG. 4.

The channel section 16 is provided so as to extend across the upper side, and in this case the front portion, of the firebox 4. Said section 16 defines conduits 27 and 28 therein and same is so positioned that combustion gases generated within the firebox 4 will pass to the rear thereof (see especially FIG. 5) upwardly into the hood 12 and thence outwardly through the flue 17. Said section 16 is further so positioned that air within the portion 22C of the intermediate passageway 22 surrounding the firebox can pass upwardly behind said section 16 into the portion 22B of said passageway 22 lying between the inner hood 12 and the intermediate hood 13 and thence through portion 22A of the passageway 22 back to the atmosphere.

Turning now to FIGS. 2–6 for a more detailed disclosure of the structure of said section 16 and its relationship to the other parts of the heat generator, said section 16 basically comprises two inverted channel members 31 and 32 fixed, as by welding, with respect to each other to form tubular members defining two elongated parallel conduits 27 and 28. Web 33 of the channel member 32 connects the flanges of the channel member 31 to define the conduit 27 as a closed conduit and a base plate 34 connects the flanges of channel member 32 to define, excepting for hereinafter-mentioned openings, the conduit 28 as likewise a closed conduit. Said base plate 34 extends the full length of the channel member 31 as hereinafter further described for the support of said conduit 36. Flange 37 extends upwardly from the base plate 34 as a heat shield which is connected to the lower edge of hood 13. The base plate 34 also forms a generally horizontal top wall portion of the firebox 4. A plate 38 extends upwardly from near the forward edge of said base plate 34 for shielding from the heat of channel member 31 whatever material, as tile T, may be placed in front thereof in connection with the installation of the parts herein illustrated into the wall of a room.

The channel member 31 extends across the passageway 22B and extends through the intermediate wall 6 of the firebox section 1 so that the conduit 27 opens at both ends into passageway 21C. However, said channel member 31 may be of somewhat less width than the corresponding dimension of the passageway 22B and does not block same.

The channel member 32 extends beyond the channel member 31 sufficiently that both its web 33 and its flanges 32A and 32B abut against the outer wall 9 of the firebox section 1. Again, however, the horizontal width of said channel 32 is substantially less than the corresponding dimension of the passageway 21C and does not block same.

One or more, here two, openings 41 and 42 are provided through the base plate 34 and corresponding, here likewise two, openings 43 and 44 are provided in register with the openings 41 and 42 through guide plates 36 placed above said openings 41 and 42 and fixed to said base plate 34. One or more damper plates 46 and 47 of any convenient kind are provided between the plate 36 and the plate 34 to control the flow of air from conduit 28 into firebox 4, as further discussed hereinafter. In the illustrated embodiment, the sliding plates 46 and 47 have tabs 48 and 49, respectively, for manually moving said plates and thereby adjusting the air flow through the openings 41 and 42.

As already implied, the walls of the firebox 4 extend sufficiently behind the section 16, and the walls of the inner hood 12 extend likewise sufficiently rearwardly, that there is ample space for combustion gases generated within the firebox 4 to pass behind the section 16 into the interior of the hood 12 and then into the flue 17 without being materially if at all inhibited by the presence of said section 16. Excepting for the provision of sufficient such space, the firebox may be of any conventional shape or size as desired.

Figure 1A:
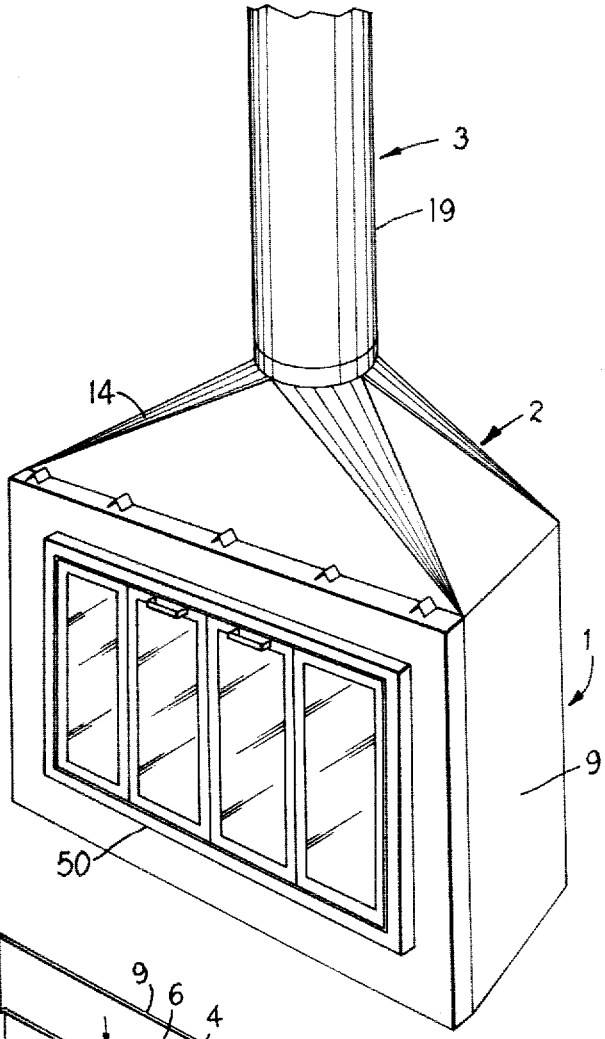
FIG. 1A is a perspective view of a fireplace section and stack fragment of the invention.
Figure 2:
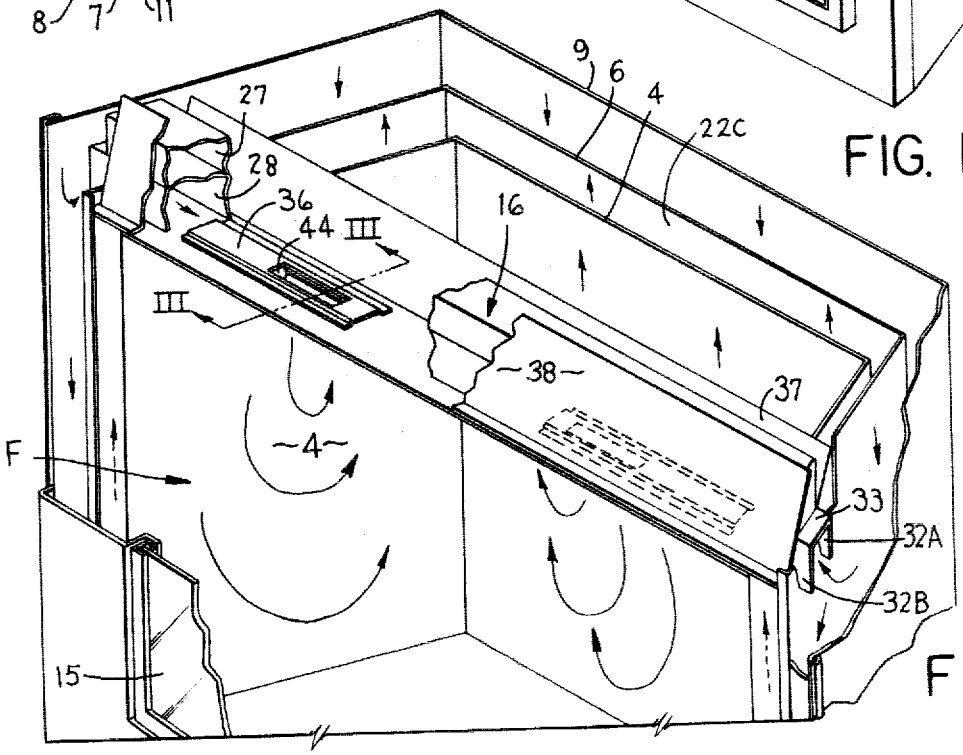
FIG. 2 is an oblique fragmentary and broken view of the firebox and portions of the surrounding walls.
Figure 3:
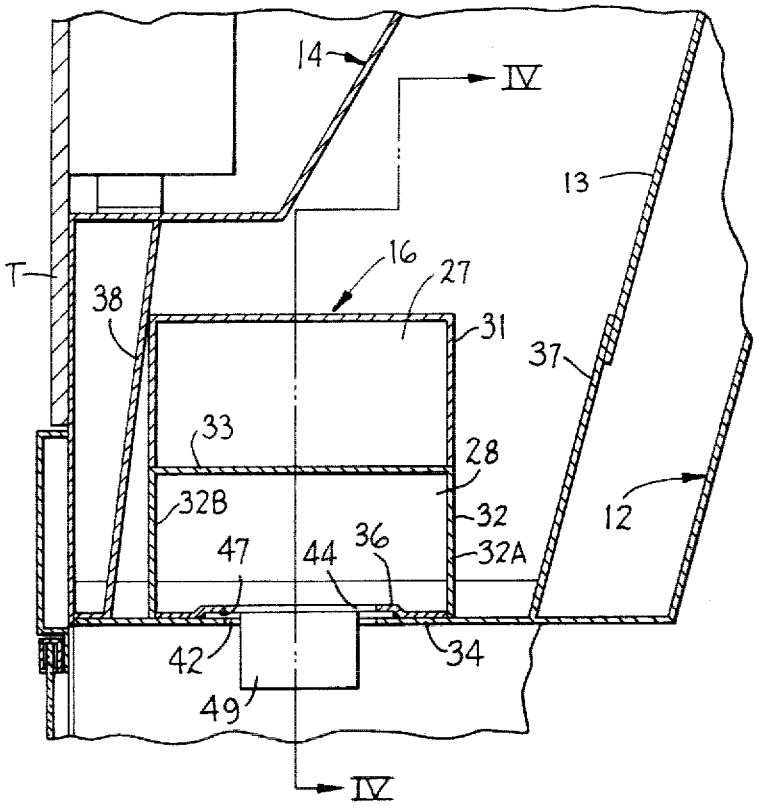
FIG. 3 is a section taken on the line III—III of FIG. 2.
Figure 4:
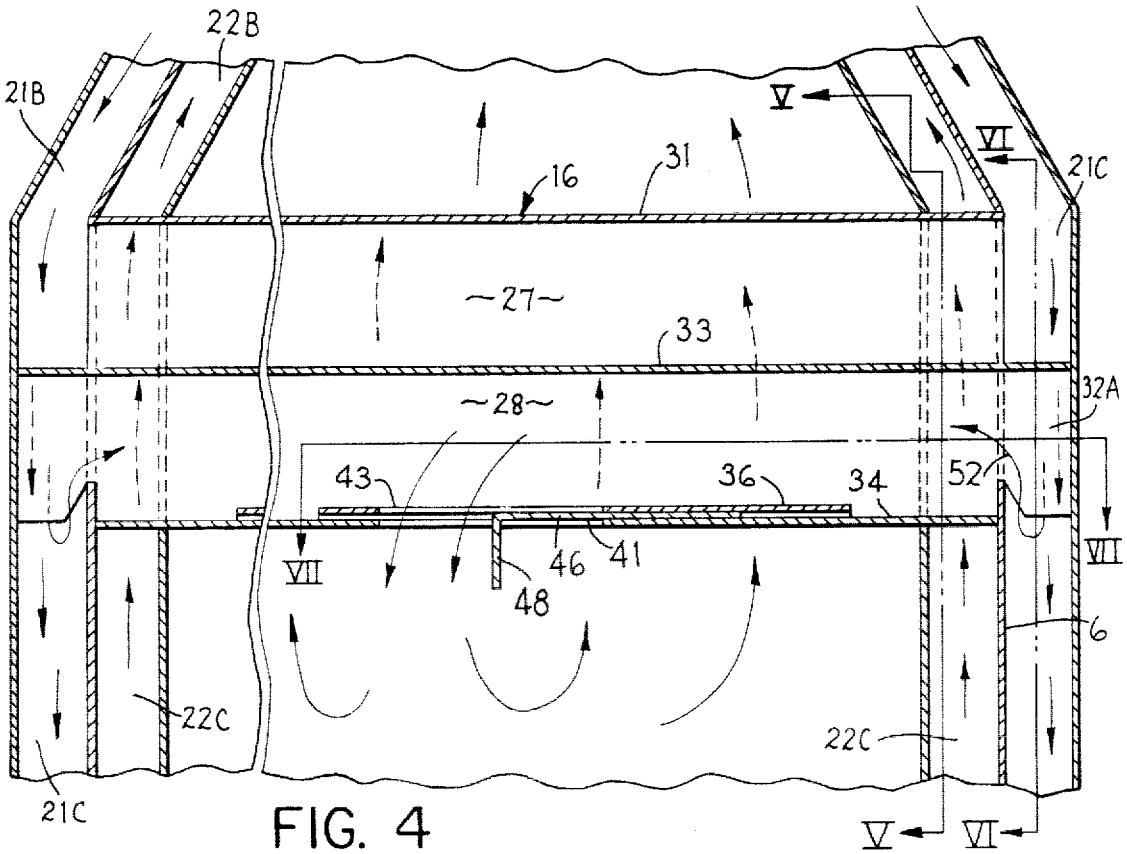
FIG. 4 is a section taken on the line IV—IV of FIG. 3.

Normal ambient air may be introduced in the conventional manner of any fireplace through the open front thereof from the adjacent room, not shown, for combustion within the firebox 4 in a conventional manner. However, in the present invention, glass doors 50 (FIG. 1A) or the like are preferably mounted upon the front of the fireplace outwardly of the openings 41 and 42 in the plate 34. Thus, when the doors are closed, combustion air is supplied to the firebox and, therefore, no air need be drawn from the adjacent room. In such case, it will be advantageous to place a heat exchanger in the firebox or flue for circulating ambient air out of and then back into such adjacent room.

Turning now to the air circulation and supply as provided by the structure described, a small amount of the air passing downwardly through the uter passageway 21 into the part 21C thereof and approaching the end of the channel member 31 may leak into the conduit 27. However, almost all of said air in the outer passageway 21C will continue on downwardly. A small portion of the air in passageway 21C will enter the conduit 28 formed by channel member 32 which extends into said outer passageway 21C. As said air reaches the lower edges of the flanges 32A and 32B, a portion thereof will flow around said edges indicated by the arrow 52 into the conduit 28 and thence, assuming one or both of the dampers are open, will pass through openings 41 and/or 42 into the interior of the firebox 4. Such air coming into the upper portion of the firebox will support the combustion occurring therein.

The major portion of the thermally siphoned air flowing through passageway 21C passes downwardly past the channel member 32 to the bottom of the firebox section 1, flows across the bottom thereof from both sides and the back thereof to the opening 8 and thence into the portion 22C of the inner passageway 22 lying below the bottom of said firebox 4. Said air will pass upwardly around said firebox through the space 22B between the inner hood 12 and the intermediate hood 13 and thence into the space 22A between the inner flue 17 and the intermediate pipe 18. As said air rises through the inner passageway 22, it becomes heated still further and moves upwardly by convection. Accordingly, this action continues drawing cold air into the outer passageway 21 effecting a continuing and effective heat barrier for protecting any surrounding combustible materials from the heat of the fireplace and the combustion gas flue. This flow pattern provides a continuous supply of combustion air from said outer passageway 21 through said dampers into the firebox 4, as aforesaid. Likewise, the channel member 31 having some access at its ends with the outer passageway 21 will tend to shield any combustible materials 53 which may be substantially directly above this portion of the firebox.

It will thus be recognized that the device of the invention provides an extremely simple structure, one which is substantially rectangular throughout and hence easy to fabricate and to join by means such as welding, but yet one which will effectively provide for constant and reliable circulation of air around the entire sides, rear and bottom of the firebox and around the entire perimeter of the hood section and chimney section for the adequate protection of surrounding combustible materials from the heat generated within said firebox. The invention also provides for the supply of combustion air at the proper point for completing the combustion taking place within the firebox, without removing air for combustion from the room interior or space adjacent to the fireplace. Thus, a highly effective and reliable operation is obtained by means of a very simple, easily fabricated structure.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a heat generator, as a domestic fireplace, comprising a firebox defining a combustion chamber; a flue section for conducting combustion gases from said combustion chamber; and means effecting the thermal siphoning flow of air around at least a portion of said firebox and said flue section; the improvement comprising:

said thermal siphoning flow means defined by a first shell disposed at least partly around and spaced from said firebox and a second shell disposed at least partly around and spaced from said first shell, the space between said first and second shells comprising a first passageway, the space between said first shell and said firebox comprising a second passageway, means forming an opening for conducting cooling air from said first passageway to said second passageway, means for conducting cooling air to said first passageway from an exterior source, and means for conducting cooling air out of said second passageway;

a hood section mounted on said firebox and an outer front wall formed by a part of said second shell;

a conduit extending across the upper side of said firebox and communicable with the flow of air in said thermal siphoning flow means, said conduit being in communication with at least one of said passageways for conducting at least a portion of said cooling air into said combustion chamber, said conduit further including a first elongated tubular member disposed across a top wall portion of said firebox between said hood section and said front wall, at least one end of said first tubular member opening into said one passageway; and means defining an opening from said conduit into said fireplace;

whereby combustion air may be conducted from said thermal siphoning means into said firebox.

2. In a heat generator, as a domestic fireplace, comprising a firebox and a flue for combustion gases leading therefrom together with means effecting the thermal siphoning flow of air therearound, the improvement wherein said thermal siphoning means comprises at least two shells, of which one thereof encompasses at least the major portion of said firebox and flue, and the second thereof encompasses said first shell, said first and second shells thereby defining an outer passageway open at its upper end to the atmosphere with its lower end adjacent the bottom of said firebox, said first shell defining with the walls of said firebox and flue an inner passageway open at its upper end to the atmosphere with its lower end communicating with the lower end of said outer passageway;

and further comprising:

a conduit extending across the upper side of said firebox and communicable with the flow of air in said thermal siphoning means, said conduit extending through said inner passageway for communication with said outer passageway; and means defining an opening from said conduit into said firebox;

whereby combustion air may be conducted from said thermal siphoning means into said firebox.

3. The improvement of claim 2, wherein said conduit communicates at each end thereof with spaced portions of said outer passageway.

4. The improvement of claim 2, wherein said conduit defines two parallel passageways, each thereof communicating with said outer passageway and one thereof selectively communicable with said firebox.

5. The device of claim 4, wherein said conduit comprises a pair of channel members positioned adjacent each other in such a manner that the web of one member closes the open side of the other member;

a closure plate for closing the open side of said one channel member whereby to provide two separate and parallel passageways; and wherein the said closure plate extends across the inner passageway but does not extend across the outer passageway, whereby air flowing in the outer passageway will enter into said one of said two parallel passageways as combustion air but air from said inner passageway will be excluded therefrom.

6. The improvement of claim 2, including an adjustable damper for controlling the opening between said conduit and said firebox.

7. The improvement of claim 2, including means blocking communication between said conduit and said inner passageway; and closure means on the front of said fireplace, the said opening from said conduit being inwardly of said closure means.

8. A fireplace including a firebox defining a combustion chamber; a flue section including a flue pipe for conducting combustion gases from said combustion chamber; means defining a passageway for conducting a thermally induced flow of cooling air around at least a portion of the exterior of said firebox for insulating said firebox from materials disposed adjacent said fireplace, said means defining said passageway including a first shell disposed at least partly around and spaced from said firebox and a second shell disposed at least partly around and spaced from said first shell, the space between said first and second shells comprising a first passageway, the space between said first shell and said firebox comprising a second passageway, means forming an opening for conducting cooling air from said first passageway to said second passageway, means for conducting cooling air to said first passageway from an exterior source, and means for conducting cooling air out of said second passageway; a hood section mounted on said firebox and an outer front wall formed by a part of said second shell; and means defining a conduit in communication with at least one of said passageways for conducting at least a portion of said cooling air into said combustion chamber, said conduit means including a first elongated tubular member disposed across a top wall portion of said firebox between said hood section and said front wall, at least one end of said first tubular member opening into said one passageway.

9. The fireplace set forth in claim 8 wherein:

said first tubular member is open at both ends to said one passageway.

10. The fireplace set forth in claim 8 wherein:

a second elongated tubular member mounted above said first tubular member and forming a conduit in communication with one of said passageways.

11. The fireplace set forth in claim 10 wherein:

said second tubular member is open at both ends to said one passageway.

12. The fireplace set forth in claim 11 together with:

an elongated plate like heat shield disposed between said tubular member and said front wall.

13. The fireplace set forth in claim 8 wherein:

said top wall has an opening for conducting combustion air into said combustion chamber from said conduit formed by said first tubular member.

14. A fireplace including a firebox defining a combustion chamber; a flue section including a flue pipe for conducting combustion gases from said combustion chamber; means defining a passageway for conducting a flow of cooling air around at least a portion of the exterior of said firebox for insulating said firebox from materials disposed adjacent said fireplace, said means defining said passageway including a shell disposed at least partly around and spaced from said firebox, means for conducting cooling air to said passageway from an exterior source, and means for conducting cooling air out of said passageway; means defining a conduit for conducting a portion of said cooling air from said passageway into said combustion chamber, said means defining said conduit including a first elongated tubular member disposed across a top wall portion of said firebox, at least one end of said first tubular member opening into said passageway; and a second elongated tubular member mounted across said top wall portion and opening at both ends to said passageway.

15. A fireplace assembly, comprising:

(a) firebox means defining a combustion chamber;

(b) a hood section disposed over said firebox means;

(c) a flue section disposed over said hood section and including an elongated flue pipe open at its top end for conducting combustion gases from said combustion chamber for discharge to the atmosphere through said top end; and (d) thermal siphoning flow means for circulating air around the periphery of said firebox means and flue section to provide a barrier to heat flow from the firebox means and flue section to materials disposed adjacent said fireplace assembly, and for enabling only a portion of said circulating air to be introduced into said combustion chamber, said thermal siphoning means comprising shell means surrounding the firebox means, the hood section, and the elongated flue pipe and defining outer and and inner adjacent elongated air passageways open to the atmosphere only at their upper ends; and (e) conduit means between said shell means and said combustion chamber through which only a portion of said circulating air flows into said combustion chamber at the top thereof with the major portion of said circulating air flowing through said elongated passageways.

16. The fireplace assembly as defined by claim 15 wherein said major portion of said circulating air flows past said conduit means without flowing therein.

17. The fireplace assembly as defined by claim 16 wherein cold air from the atmosphere flows into the upper end of the outer passageway and heated air flows upwardly through the inner passageway to exit to the atmosphere at its upper end.

18. The fireplace assembly as defined by claim 15 further comprising heat shield means disposed adjacent said firebox means for providing a barrier to heat flow from said combustion chamber to combustible materials adjacent said firebox means.

19. The fireplace assembly as defined by claim 18 wherein said heat shield means extends across the top of said firebox means over the location through which said portion of said circulating air flows into said combustion chamber.

20. The fireplace assembly as defined by claim 19 wherein said heat shield means includes a generally tubular shaped member having an opening at at least one end thereof through which air is introduced into said tubular shaped member.

* * * * *